US005447610A

United States Patent [19]

Sharifian

[11] Patent Number: 5,447,610

[45] Date of Patent: Sep. 5, 1995

[54] ELECTROLYTIC CONVERSION OF NITROGEN OXIDES TO HYDROXYLAMINE AND HYDROXYLAMMONIUM SALTS

[75] Inventor: Hossein Sharifian, Austin, Tex.

[73] Assignee: Sachem, Inc., Austin, Tex.

[21] Appl. No.: 264,599

[22] Filed: Jun. 23, 1994

[51] Int. Cl.[6] ..... C25B 1/00

[52] U.S. Cl. ..... 204/101

[58] Field of Search ..... 204/101

[56] References Cited

U.S. PATENT DOCUMENTS

| | | | |
|---|---|---|---|
| 4,321,313 | 3/1982 | Langer | 204/101 |
| 4,645,579 | 2/1987 | Weiss et al. | 204/182.4 |
| 4,818,353 | 4/1989 | Langer et al. | 204/74 |
| 4,849,073 | 7/1989 | Dotson et al. | 204/101 |
| 4,968,394 | 11/1990 | Dotson | 204/101 |
| 5,259,934 | 11/1993 | Sharifian et al. | 204/101 |
| 5,281,311 | 1/1994 | Sharifian et al. | 204/101 |

FOREIGN PATENT DOCUMENTS 2602802 8/1987 France .

OTHER PUBLICATIONS

Bathia et al; "Hydroxyamine Production by Electroreduction of Nitric Oxide in a Trickle Bed Cell", *The Canadian Jnrl. of Chemiical Engrg.*, vol. 57, Oct. 1979, pp. 631–637.

Colucci et al., "The Electro Reduction of Nitric Oxide on Bulk Platinum in Acid Solutions", *Electrochimica Acta*, vol. 4, pp. 521–528, 1985.

Janssen et al.; "Reduction of Nitric Oxide at a Platinum Cathode in an Acidic Solution", *Electrochimica Acta*, vol. 22, pp. 27–30, (1977).

*Primary Examiner*—John Niebling
*Assistant Examiner*—Brenda Mee
*Attorney, Agent, or Firm*—Renner, Otto, Boisselle & Sklar

[57] ABSTRACT

A process is described for preparing hydroxylamine and hydroxylammonium salts represented by the formulae $$(NH_3OH)^+_yX^{-y}$$

wherein X is an anion of an acid and y is a number equal to the valence of X, said process comprising electrolytically reducing a mixture comprising at least one nitrogen oxide and either a neutral electrolyte to form hydroxylamine or an acidic electrolyte such as an organic or inorganic acid $H_yX$ to form a hydroxylammonium salt provided the acid is not perchloric acid or sulfuric acid when the nitrogen oxide is nitric oxide. More particularly, the electrolytic reduction of the present invention is conducted in an electrolysis cell comprising an anolyte compartment containing an anode, a catholyte compartment containing a cathode, and a divider separating said anolyte and catholyte compartments. The mixture of at least one nitrogen oxide and the electrolyte is present in the catholyte compartment, and an acid is present in the anolyte compartment. The present invention provides an electrolytic process for preparing hydroxylamine and hydroxylammonium salts containing reduced amounts of ammonium products, the process consumes a reduced amount of electric energy when compared to nitric acid reduction and does not require a mercury cathode.

27 Claims, 2 Drawing Sheets

ELECTROLYTIC CONVERSION OF NITROGEN OXIDES TO HYDROXYLAMINE AND HYDROXYLAMMONIUM SALTS

TECHNICAL FIELD

The present invention relates to a process for preparing hydroxylamine or hydroxylammonium salts. More particularly, the invention relates to a process for electrolytically converting nitrogen oxides to hydroxylamine or hydroxylammonium salts.

BACKGROUND OF THE INVENTION

Hydroxylammonium salts may be represented by the formula:

$$(NH_3OH)^+{}_yX^{-y}$$

wherein X is an anion of an acid and y is a number equal to the valence of X. Hydroxylammonium salts are compounds which have a variety of applications. For instance, hydroxylammonium nitrate may be used as a component of liquid propellant and as a reducing agent in photographic operations. In some of these applications, it is desirable that a hydroxylammonium salt solution of high purity is available.

There exist several production methods to manufacture hydroxylammonium salts. In the case of hydroxylammonium nitrate for example, some of these methods include: electrodialysis of hydroxylammonium chloride and nitrate; reaction of hydroxylammonium sulfate and barium nitrate; three-step cation exchange process employing hydroxylammonium sulfate and nitric acid; and electrolytic reduction of nitric acid. Some of these methods, however, do not provide hydroxylammonium salt solutions of high purity which some applications of the compound require. As a result, procedures have been developed to purify the hydroxylammonium salt solutions produced by existing methods. Nevertheless, there remains a substantial demand for large quantities of high purity hydroxylammonium salt solutions.

French Patent 2,602,802 is directed to an electrolytic process to directly produce high purity solutions of hydroxylammonium nitrate from nitric acid. In particular, a process is described for producing by electrolysis a hydroxylammonium nitrate solution in an electrochemical cell containing a cathode compartment, an anode compartment and a separator between the cathode compartment and anode compartment. The process is characterized in that it includes the following operations: (a) introducing a catholyte, essentially containing an aqueous nitric acid solution, in the cathode compartment; (b) introducing an anolyte solution into the anode compartment; (c) electrolyzing the catholyte to a cathode potential between about 0.5 and 1.4 volts compared to the standard calomel electrode, while keeping the temperature of the reaction to the cathode below about 50° C., in order to produce a hydroxylamine solution; and (d) recovering the hydroxylammonium nitrate solution from the cathode compartment.

U.S. Pat. No. 4,645,579 relates to aqueous solutions of hydroxylamine which are prepared from aqueous hydroxylammonium salt solutions by electrodialysis by a method in which the aqueous hydroxylammonium salt solution is fed into the middle zone of an electrolysis cell, which is divided into a cathode zone, an anode zone and a middle zone by means of semipermeable membranes, and is electrolyzed, and the catholyte used is an alkali metal hydroxide solution containing ammonia and/or amines.

The production of hydroxylamine by the electroreduction of nitric oxide in sulfuric acid is described by L. J. J. Janssen et al in *Electrochimica Acta,* 1977, Vol. 22, pp. 27–30 and by M. L. Bathia et al in *The Canadian Journal of Chemical Engineering,* Vol. 57, October 1979, pp. 631–7. Janssen et al utilize a platinum cathode, and Bathia et al utilize a cathode bed of tungsten carbide particles. The electroreduction of nitric oxide on bulk platinum in perchloric acid and sulfuric acid solutions is described by J. A. Colucci et al in *Electrochimica Acta,* Vol. 30, No. 4, pp. 521–528, 1985.

SUMMARY OF THE INVENTION

A process is described for preparing hydroxylamine and hydroxylammonium salts represented by the formulae $$(NH_3OH)^+{}_yX^{-y}$$

wherein X is an anion of an acid and y is a number equal to the valence of X, said process comprising electrolytically reducing a mixture comprising at least one nitrogen oxide and either a neutral electrolyte to form hydroxylamine or an acidic electrolyte such as an organic or inorganic acid $H_yX$ to form a hydroxylammonium salt provided the acid is not perchloric acid or sulfuric acid when the nitrogen oxide is nitric oxide. More particularly, the electrolytic reduction of the present invention is conducted in an electrolysis cell comprising an anolyte compartment containing an anode, a catholyte compartment containing a cathode, and a divider separating said anolyte and catholyte compartments. The mixture of at least one nitrogen oxide and the electrolyte is present in the catholyte compartment, and an acid is present in the anolyte compartment. The present invention provides an electrolytic process for preparing hydroxylamine and hydroxylammonium salts containing reduced amounts of ammonium products. The process consumes a reduced amount of electric energy when compared to nitric acid reduction and does not require a mercury cathode.

DESCRIPTION OF THE PREFERRED EMBODIMENTS

Figure 2:
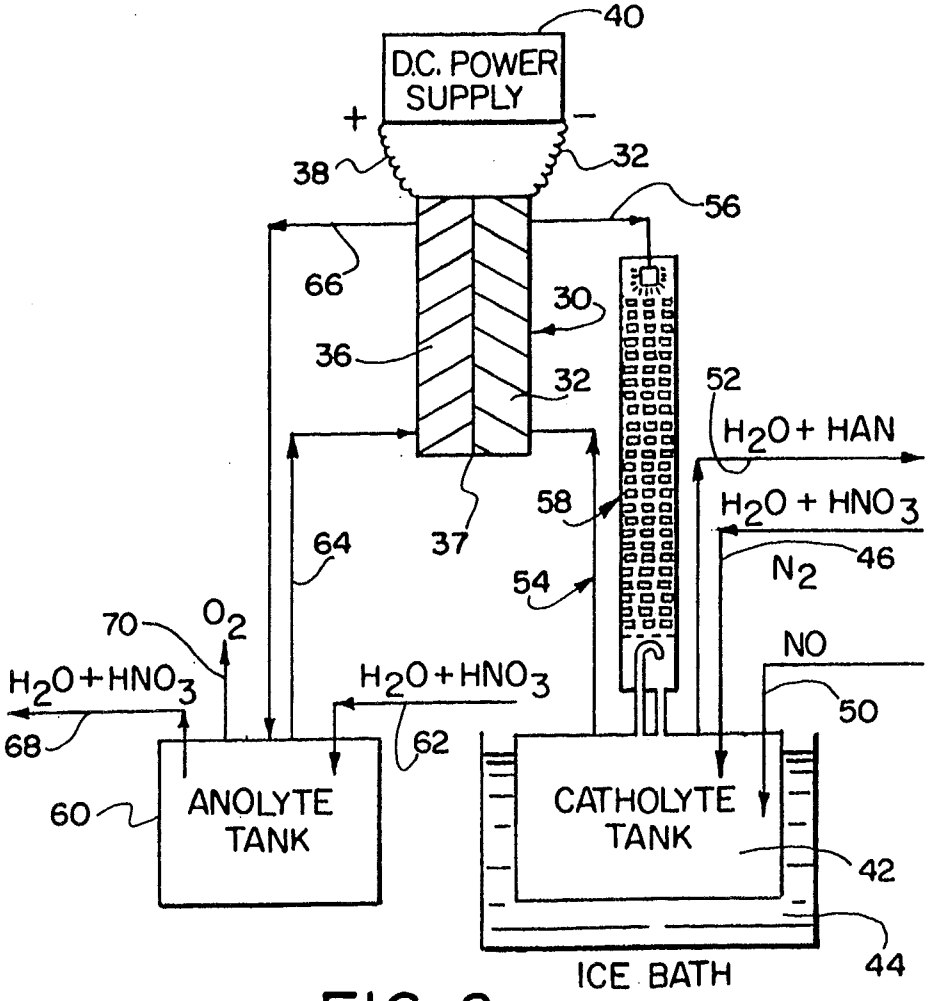
FIG. 2 is a schematic illustration of a process for preparing hydroxylammonium salts comprising a closed loop.

In one embodiment of the invention, the process for preparing hydroxylamine or hydroxylammonium salts comprises electrolytically reducing a mixture of (A) at least one nitrogen oxide; and (B) an electrolyte selected from (B-1) a neutral electrolyte to form hydroxylamine or (B-2) an acidic electrolyte to form a hydroxylamine salt, provided the acidic electrolyte does not contain perchloric or sulfuric acid when the nitrogen oxide is nitric oxide. The nitrogen oxides may be nitric oxide (NO), nitrogen dioxide ($NO_2$), nitrogen trioxide ($NO_3$), dinitrogen trioxide ($N_2O_3$), nitrogen pentoxide $N_2O_5$, and mixtures thereof. Nitric oxide is a preferred nitrogen oxide in the process of the invention. The neutral electrolytes useful in the invention may be any salt which is soluble in the media and does not react at the electrode. Examples of salts useful as electrolytes include quaternary ammonium salts such as tetralkylammonium salts including tetraalkylammonium halides, perchlorates, fluoborates, etc. The alkyl groups may be the same or different and generally will contain from 1 to 4 carbon atoms. Specific examples include tetramethylammonium chloride, tetraethylammonium bromide, dimethyldiethylammonium chloride, etc. The mixture in the catholyte compartment comprising a neutral electrolyte may also contain a stabilizer for the hydroxylamine formed in the compartment. Examples of stabilizers include quinoline derivatives, thiocarboxylic acids, thiosulfates, hydroxy anthraquinone, etc. The amount of stabilizer in the mixture may range from about $5\times10^{-4}\%$ to about 1% by weight based on the weight of electrolyte.

The hydroxylammonium salts which can be prepared from nitrogen oxide in accordance with the process of the present invention may be represented by the formulae $$(NH_3OH)^{+}{}_{y}X^{-y}$$

wherein X is an anion of an acid and y is a number equal to the valence of X. Specific examples of anions include $Cl^-$, $Br^-$, $SO_4^{-2}$, $HSO_4^-$, $PO_4^{-3}$, $H_2PO_4^{-l}$, $HPO_4^{-2}$, etc.

When the desired product is a hydroxylammonium salt, the mixture which is electrolytically reduced at the cathode comprises at least one nitrogen oxide and an acidic electrolyte. The acidic electrolyte generally will comprise an acid which may be an organic or inorganic acid in water, a mixture of water and one or more organic solvents, or in some instances an organic solvent.

Specific examples of inorganic acids represented by formula $H_yX$ which may be utilized in the mixture with nitrogen oxides include nitric acid, halogen acids such as hydrofluoric acid, hydrochloric acid, hydrobromic acid and hydriodic acid, sulfuric acid, perchloric acid, boric acid and phosphorus acids such as phosphorous acid and phosphoric acid, provided the acid is not sulfuric acid or perchloric acid when the nitrogen oxide is nitric oxide. Nitric acid is a preferred inorganic acid. Examples of organic acids represented by the formula $H_yX$ include carboxylic acids such as formic acid, acetic acid, propionic acid, etc.; organic phosphorus acids such as dimethylphosphoric acid and dimethylphosphinic acid; or sulfonic acids such as methanesulfonic acid, ethanesulfonic acid, 1-pentanesulfonic acid, 1-hexanesulfonic acid, 1-heptane sulfonic acid, benzenesulfonic acid, toluenesulfonic acid, etc.

Specific examples of hydroxylammonium salts which can be prepared in accordance with this invention include hydroxylammonium nitrate, hydroxylammonium hydrochloride, hydroxylammonium fluoride, hydroxylammonium formate, hydroxylammonium acetate, hydroxylammonium phosphate, hydroxylammonium methylsulfonate, hydroxylammonium toluene sulfonate, etc.

The type of electrolysis cell used in the novel process of the present invention may be any of the known electrolysis cells, and the cells may be composed of conventional cell materials which are compatible with the materials being charged into the cells. The cells may be adapted to operate at atmospheric pressure or at elevated pressures. In one presently preferred embodiment the cell is one capable of operating at elevated pressures of at least 10 psig up to about 100 psig or higher. Since the anode and cathode do not directly enter into the reaction, they also may be made from a variety of materials that do not react with the solutions added to the cells. In a preferred embodiment, the cathode comprises a material which exhibits electrocatalytic activity for nitrogen oxide reduction to hydroxylamine or hydroxylammonium salts. Suitable cathodes may comprise tungsten carbide, silver, manganese diode or platinum. Mercury cathodes are not generally used. For example, the cathode may comprise tungsten carbide, platinum on carbon, silver on carbon, manganese dioxide on carbon, or a platinized titanium.

In one embodiment the cathode is a gas diffusion cathode. The gas-diffusion electrode may comprise a conventional cathode structure formed of a suitable porous hydrophobic material such as polytetrafluoroethylene (PTFE), mixed with carbon black and a catalyst. In one preferred embodiment, the gas diffusion cathode is a hydrophobic cathode comprising a porous element having a first surface portion which is in contact with the nitric oxide charged to the catholyte and a second surface portion which is in contact with the aqueous acidic mixture in the catholyte compartment. For example, the gas-diffusion cathode may comprise a porous material such as a PTFE fabric or a carbon cloth fabric coated on one side with a suitable catalytic material such as platinum, silver, gold, and mixtures thereof to form an "active layer."

Figure 3:
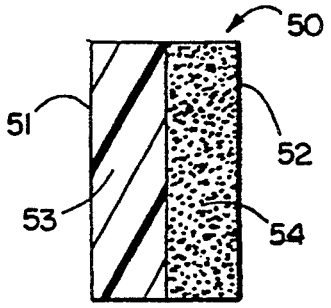
FIG. 3 is a schematic cross-section of an example of a gas-diffusion cathode useful in the invention.

FIG. 3 is a schematic illustration of one embodiment of a gas-diffusion electrode useful in the process of the present invention. As shown in FIG. 3, the cathode 50 is formed essentially of a two-component laminate defining the gas contacting surface 51 and the opposed electrolyte contacting surface or "active surface" 52. An electrically conductive porous gas carrier layer 53 defines the gas-contacting surface 51, and layer 53, for example, may comprise a mixture of a hydrophobic material such as porous PTFE and an electrically conductive material such as carbon black. Layer 54, the active layer, comprises a suitable catalytic material such as platinum, silver, gold, etc., and, optionally, carbon powder. In some instances, the materials of layer 53 and layer 54 may be intermixed into a single layer. The entire structure of cathode 50 in FIG. 3 is porous. The function of layer 53 is to allow ready transmission of nitrogen oxide to the active layer 54. Since layer 53 is hydrophobic, it serves to repel liquid electrolyte and prevent the liquid electrolyte from passing through the electrode into the gas side of the cell.

The anodes generally may be high purity graphite or platinum electrodes or a titanium electrode coated with an oxide of a material belonging to the platinum group. For example, suitable anodes include ruthenium oxide or iridium oxide on titanium.

Generally, the electrolysis is carried out in a cell comprising an anolyte compartment and a catholyte compartment. The compartments are separated by means of a divider. The divider in the electrolysis cells used in this invention may be any material which functions as a gas separator and a diffusion barrier. Examples of such divider materials include inert fabrics, sintered glass, ceramics and membrane diaphragms. Membrane diaphragms are particularly useful and are preferred. Of the membrane dividers, the cation selective membranes are particularly preferred.

The cation selective membranes comprise well known classes of organic commercial polymers, often thermoplastic type, containing polar groups. The cation selective membrane may be a cation exchange resin or other material, permeable to and capable of transferring cations. The membranes may comprise materials based on the fluorocarbon, polystyrene or polypropylene series. Additionally, it is preferable to use a durable semipermeable membrane which is acid stable. Preferably, the cation selective membranes used in the present invention include fluorinated membranes containing cation-exchange groups such as perfluorosulfonic acids and perfluorosulfonic acid/perfluorocarboxylic acid, perfluorocarbon polymer membranes such as those sold by the E.I. DuPont Nemours and Company under the trade designation "Nation". Other suitable cation-exchange membranes include styrene-divinyl benzene copolymer membranes containing cation-exchange groups such as sulfonate groups, carboxylate groups, etc. Other specific examples of commercially available cation selective membranes are Raipore from RAI Pall, Tosflex from Tosoh Corporation, and Neosepta from Tokuyama Soda.

The anolyte compartment of the electrolysis cell contains an anode, acid and water and optionally, organic solvents. Any acid can be used in the anolyte compartment, but generally the acid in the anolyte compartment is the same as the acid in the catholyte compartment for highest purity. The concentration of the acid in the anolyte compartment is from about 1% to about 50% by weight, preferably from about 5% to about 15% by weight. The temperature is about 10° C. to about 30° C., preferably about 10° C. to about 25° C.

The catholyte compartment of the electrolysis cell comprises a cathode and a mixture of at least one nitrogen oxide, and an electrolyte as described above. When the desired product is a hydroxylammonium salt, the electrolyte is an acidic electrolyte, and the choice of acid in the electrolyte is determined by the hydroxylammonium salt desired to be produced. The acid in the catholyte mixture should contain the anion of the desired salt. That is, if hydroxylammonium nitrate is the desired salt, the acid in the catholyte mixture is nitric acid. If the desired salt is hydroxylammonium chloride, the acid is hydrochloric acid. If the desired salt is hydroxylammonium acetate, the acid in the catholyte mixture should be acetic acid. The amount of nitrogen oxide in the catholyte mixture is an amount to provide a saturated solution or mixture. The concentration of acid in the catholyte mixture may be from about 1% to about 25% by weight. Preferably the acid concentration is from about 5% to about 15% by weight. The temperature of the catholyte is about 10° C. to about 30° C., preferably about 10° C. to about 25° C. The water, used in the solutions of the present invention, is preferably deionized water, and more preferably very pure deionized water.

The electrolysis of the mixture in the catholyte compartment containing the nitrogen oxide(s) and electrolyte is effected by impressing a direct current voltage between the anode and cathode with an apparent current density of about 10 to about 500, more often from about 20 to 100 mA/cm$^2$ at about 1 volt to about 8 volts. The current is applied to the electrolysis cell for a period of time effective to produce the hydroxyamine salt in the catholyte compartment at a desired concentration.

The electrolytic cell can be operated batchwise or in a continuous operation. Circulation is effected by pumping and/or by gas evolution. In one embodiment, the acid concentration in the anolyte is maintained at a constant concentration by the employment of a water-feed into the anolyte compartment. Nitrogen oxides and acid solution can be added periodically or continuously to the catholyte compartment to maintain an appropriate concentration.

Figure 1:
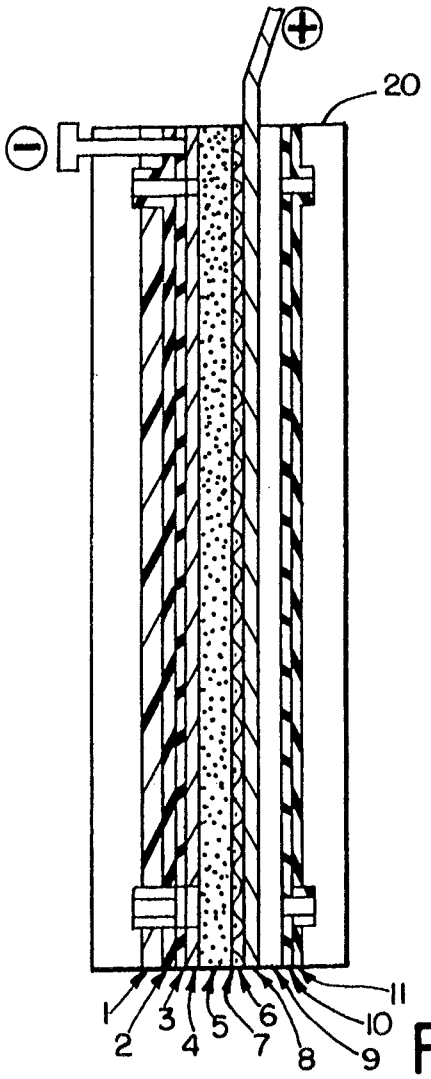
FIG. 1 is a schematic cross-section of an electrolysis cell useful in preparing hydroxylamine or the salts of the invention.

One example of an electrolytic cell useful for preparing hydroxylamine or the hydroxylammonium salts of the present invention is illustrated in FIG. 1. One advantage of this type of electrolytic cell is that it can be operated at atmospheric or at elevated pressures. The cell 20 comprises external compression plates 1 and 11 which may be made of various materials including polyolefins such as polypropylene, gaskets 2, 3 and 10 which may generally be made of any suitable elastomeric material such as rubber, a metal cathode plate 4, a bed 5 of catalyst particles such as tungsten carbide in contact with cathode plate 4, a fine mesh plastic screen 7 in contact with the bed of catalyst particles 5 and a cationic selective membrane 6. The plastic screen 7 is adjacent to the membrane 6, and the screen prevents the catalyst particles from direct contact with the membrane to prevent damage of the membrane. The space between the cathode plate 4 and the membrane 6 defines the catholyte compartment of the cell 20. Anode plate 8 is positioned next to but away from the membrane 9 to define the anolyte compartment 9. The gaskets 2, 3 and 9 and the compression plates 1 and 11 are positioned to maintain the cell in the desired configuration and at a desired pressure.

The cell illustrated in FIG. 1 may be operated in a batch or continuous manner, and can be operated at atmospheric or at an elevated pressure. Pressures of from about 10 to about 60 psig or greater can be utilized. It has been observed that the current efficiency increases with pressure, and the formation of undesirable ammonium products decreases as pressure increases.

FIG. 2 illustrates one embodiment of the invention for preparing hydroxylammonium nitrate wherein the catholyte mixture which is supplied to the catholyte compartment of an electrolytic cell comprises a mixture of water, nitric acid and nitric oxide. (Other nitrogen oxides could be used.) In a different embodiment, nitric acid solution and nitric oxide gas are separately supplied to the catholyte compartment of an electrolytic cell. In the embodiment illustrated in FIG. 2, a catholyte mixture is prepared in catholyte tank 42 contained in an ice bath 44. A nitric acid solution is fed to the catholyte tank as illustrated by line 46, and nitric oxide is fed to the catholyte tank as shown by line 50. The mixture formed in the catholyte tank is supplied to a two-compartment electrolytic cell 30 comprising a catholyte compartment 32 and an anolyte compartment 36 separated by divider 37. The cathode (not shown) of the catholyte compartment 32 is attached to a power supply 40 by wire 34, and the anode (not shown) of anolyte compartment 36 is attached to the power supply 40 by wire 38. The catholyte mixture is supplied to the electrolytic cell 30 by way of line 54. The apparatus of FIG. 2 also comprises an anolyte tank 60, and water and nitric acid are supplied to the anolyte tank 60 as shown by line 62. The anolyte solution or a mixture contained in anolyte tank 60 is supplied to the electrolytic cell 30 by way of line 64. After the electrolysis has proceeded to the desired extent to provide sufficient quantity of the desired hydroxylammonium nitrate, a mixture is withdrawn from the catholyte compartment as shown by line 56, passed through an absorption tower 58 and returned to the catholyte tank 42. As the concentration of hydroxylammonium nitrate increases to the desired concentration, a portion of the mixture contained in the catholyte tank is removed as shown by line 52, and the hydroxylammonium nitrate is recovered from the mixture. Additional amounts of water and nitric acid can be added as makeup to the catholyte tank as shown by line 46. The mixture which is recovered from the anolyte compartment of the cell 30 is returned to the anolyte tank 60 as shown by line 66. The oxygen which is present in the mixture recovered from the anolyte compartment can be removed and vented to the air as shown by line 70, and at least a portion of the spent nitric acid solution can be removed from the anolyte tank as shown by line 68. Fresh nitric acid solution can be added to the anolyte tank as shown by line 62 to replace the spent nitric acid solution which has been removed from the anolyte tank.

Figure 4:
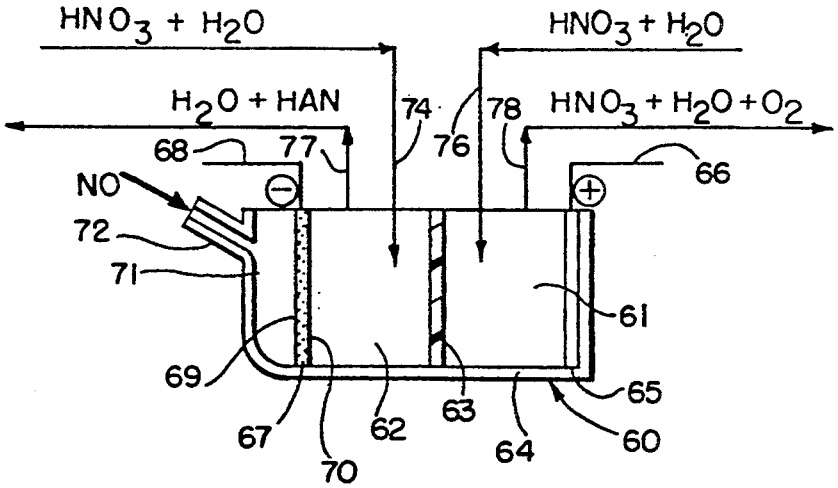
FIG. 4 is a schematic cross-section of another electrolysis cell and process.
Figure 5:
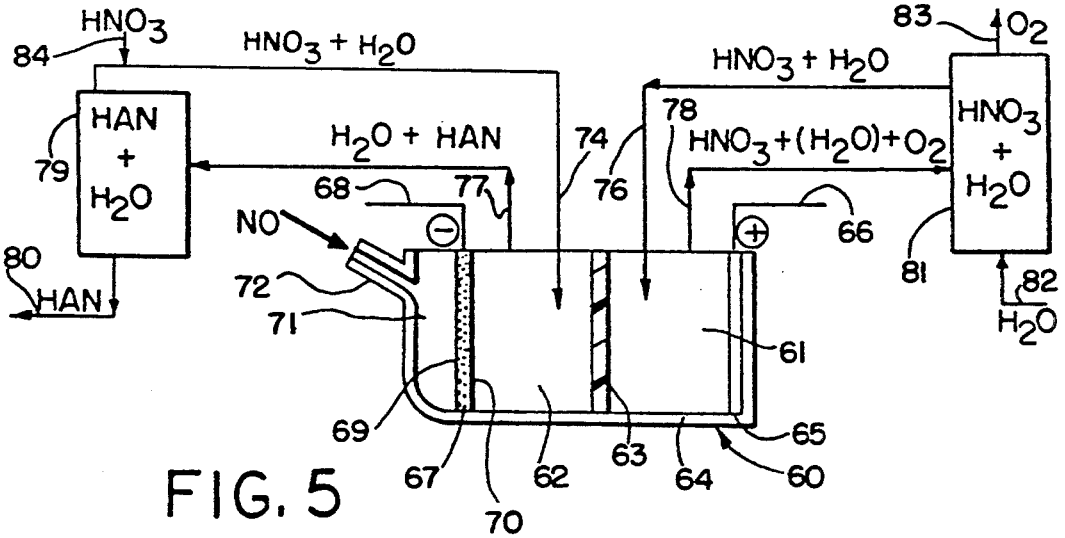
FIG. 5 is a schematic cross-section of another electrolysis cell and process comprising a closed loop.

Examples of electrolysis cells useful in the process of the present invention and which include a gas diffusion cathode are shown in FIGS. 4 and 5 with regard to the formation of hydroxylammonium nitrate. Hydroxylamine and other hydroxylammonium salts of the invention can be prepared using this cell.

In FIG. 4, an electrolysis cell 60 comprises an anolyte compartment 61 and a catholyte compartment 62 separated from each other by a cation selective membrane 63 within outer housing 64. The anolyte compartment 61 contains an anode 65 which is attached to a power supply (not illustrated) by wire 66. The catholyte compartment 62 contains a gas diffusion cathode 67 which comprises a porous element having a first surface 69 and a second surface 70. The first surface 69 of the cathode 67 is exposed to a nitric oxide-containing gas contained in a chamber 71 of housing 64, and the second surface (opposite surface) 70 of the cathode (active layer) is in contact with the aqueous mixture in the catholyte compartment 62. As illustrated in the embodiment of FIG. 4, wherein the acid in the catholyte compartment is nitric acid, a nitric oxide-containing gas is fed to chamber 71 at inlet 72. Under pressure, the nitric oxide passes through the cathode 67 into the catholyte compartment 62. The pressure should be sufficient to force the nitric oxide through the cathode but not significantly greater. An anolyte mixture comprising an acid such as nitric acid and water is supplied to the anolyte compartment as illustrated by line 76, and a catholyte comprising an aqueous solution of nitric is supplied to the catholyte compartment as shown by line 74. After passage of a direct current through the electrolysis cell, at least a portion of the catholyte containing the desired hydroxylammonium nitrate and water is withdrawn as shown by line 77, and the hydroxylammonium nitrate can be recovered from the withdrawn catholyte. A portion of the anolyte which contains oxygen is withdrawn as shown by line 78, and a fresh nitric acid solution can be added as shown by line 76.

Another example of an electrolysis cell containing a gas diffusion cathode, and the process of the present invention is illustrated with hydroxylammonium nitrate in the flow diagram of FIG. 5 which provides a closed loop with resulting favorable economics of operation. In FIG. 5, the electrolysis cell 60 and the various numbered components of the electrolysis cell have the same numbers and definition as described for FIG. 4. In the closed system illustrated in FIG. 5, after a current is passed through the electrolysis cell, at least a portion of the catholyte is withdrawn from the catholyte compartment 62 as shown by line 77 and transferred to recovery zone 79. The catholyte which is withdrawn from the catholyte compartment 62 and transferred to recovery zone 79 contains the desired hydroxylammonium nitrate and water. The hydroxylammonium nitrate is recovered from the catholyte solution in recovery zone 79 by techniques known to those skilled in the art as shown by line 80. The solution which remains after removal of the desired hydroxylammonium nitrate is replenished with nitric acid as shown by line 84 and recycled to the catholyte compartment as shown by line 74.

The anolyte contained in the anolyte compartment 61 after electrolysis contains nitric acid, oxygen and a reduced amount of water. At least a portion of this anolyte is removed from the anode compartment as shown by line 78 and transferred to makeup zone 81. The amount of water in this solution is increased as shown by line 82 to the desired operating level for recycle, and this solution is charged to the anolyte compartment as shown by line 76. Oxygen which is formed during the electrolysis is removed from the solution in the makeup zone 81 is indicated by line 83.

Although the embodiments illustrated in FIGS. 2, 4 and 5 illustrate the formation of hydroxylammonium nitrate, the electrolytic cells and the process described can be utilized to prepare hydroxylamine by using a neutral electrolyte in the catholyte compartment or other hydroxylammonium salts can be prepared by utilizing acids other than nitric acid. Thus, a chloride salt can be prepared utilizing hydrochloric acid solutions in place of the nitric acid solutions, borate salts can be prepared utilizing boric acid in placed of the nitric acid, and formate or acetate salts can be prepared by substituting formic acid or acetic acid for nitric acid in the above discussions.

The following examples illustrate the preparation of the hydroxylammonium salts of the present invention. Unless otherwise indicated in the examples and elsewhere in the specification and claims, all parts and percentages are by weight, temperatures are in degrees centigrade, and pressures are at or near atmospheric pressure.

EXAMPLES 1–4

An electrolytic cell similar to the cell shown in FIG. 1 is prepared containing a titanium/ruthenium oxide anode with a surface area of about 157 $cm^2$ and a packed bed of 35 mesh tungsten carbide particles. The catholyte compartment consists of a shallow rectangular cathode chamber 4.5 cm wide, 35 cm high and 0.5 cm deep. A piece of stainless steel is used as a current feeder, and the anolyte and catholyte compartments are separated by means of a cation selective Nation 423 membrane from DuPont. The anolyte and catholyte solutions are 2.3 molar (about 10% by weight) nitric acid, and the solutions are pumped through the cell at 150 ml/min and 250 ml/min, respectively. Prior to introduction of the nitric oxide into the cell, a nitric acid solution is circulated in the cell to activate or reactivate the tungsten carbide particles. The electrolysis is carried out at a constant current of 5 amps (apparent current density of 32 mA/cm$^2$) at about 15° C. The cell voltage is about 3.0. The electrolysis is conducted for a period of 10 hours at various cell pressures as indicated in the following table. The results of the analysis of the catholyte solution recovered from the electrolytic cell also is summarized in the following table.

TABLE

| Ex. No. | Pressure (psi) | Hydroxylammonium Nitrate Concentration (M) | Ammonium Nitrate Concentration (M) | Hydroxylammonium Nitrate/Ammonium Nitrate Ratio | Current Efficiency % |
|---|---|---|---|---|---|
| 1 | 10 | 0.09 | 0.19 | 0.5 | 15 |
| 2 | 30 | 0.15 | 0.15 | 1 | 25 |
| 3 | 70 | 0.30 | 0.06 | 5 | 50 |
| 4 | 90 | 0.40 | 0.03 | 12 | 65 |

As can be seen from the results reported in the above table, as the pressure increases, the concentration of the desired hydroxylammonium nitrate and the current efficiency increase, and the formation of the undesirable ammonium nitrate by-product decreases.

EXAMPLE 5

The general procedure of Example 2 is repeated except that the catholyte compartment is packed with 1% platinum on carbon (30–150 mesh). Analysis of the catholyte solution after electrolysis indicates the presence of 0.27M hydroxylammonium nitrate and 0.05M of ammonium nitrate. The cell current deficiency is about 64%.

EXAMPLE 6

An electrolytic cell is prepared similar to the cell described in FIGS. 4 and 5. The cell contains a titanium/ruthenium oxide anode having a surface area of about 100 cm$^2$, and a gas diffusion cathode having a surface area of about 100 cm$^2$. The gas diffusion cathode comprises 0.50 mg/cm$^2$ platinum on black pearls 2000 carbon. The electrocatalyst is embedded in a PTFE carbon matrix. The gas diffusion electrode is positioned in the cell such that the carbon cloth fabric is exposed to the gas side, and the smooth active layer of the electrode is exposed to the electrolyte side. Electrical contact to the carbon cloth is made by using a ribbed conductive copper plate arrangement. The anolyte and catholyte compartments are separated by means of a cationic selective Nation 423 membrane from DuPont. The anolyte and catholyte solutions are 1.5M nitric acid. Nitric oxide gas is supplied to the cell at a constant flow rate, and electrolysis is conducted at a constant current of about 5 amp at a temperature of about 20° C. The nitric oxide is successfully converted to hydroxylammonium nitrate.

While the invention has been explained in relation to its preferred embodiments, it is to be understood that various modifications thereof will become apparent to those skilled in the art upon reading this specification. Therefore, it is to be understood that the invention disclosed herein is intended to cover such modifications as fall within the scope of the appended claims.

I claim:

1. A process of preparing hydroxylamine or a hydroxylammonium salt by electrolytically reducing a mixture of (A) at least one nitrogen oxide and (B) an electrolyte selected from (B-1) a neutral electrolyte to form hydroxylamine or (B-2) an acidic electrolyte to form a hydroxylammonium salt, provided the acidic electrolyte does not contain perchloric or sulfuric acid when the nitrogen oxide is nitric oxide, wherein the mixture is electrolytically reduced in an electrolysis cell comprising an anolyte compartment containing an anode and an acid, a catholyte compartment containing a cathode and the mixture, said cathode comprising a packed bed of tungsten carbide particles or platinum on carbon, and a divider separating said anolyte and catholyte compartments.

2. The process of claim 1 wherein nitrogen oxide comprises nitric oxide.

3. The process of claim 1 wherein the acidic electrolyte is an aqueous mixture comprising an inorganic acid selected from nitric acid, halogen acids, boric acid or phosphorus-containing acids.

4. The process of claim 1 wherein the acidic electrolyte is an aqueous mixture comprising an organic acid selected from carboxylic acids, organic phosphorus-containing acids or sulfonic acids.

5. The process of claim 1, wherein the electrolyte (B) is (B-2) and comprises aqueous nitric acid.

6. The process of claim 1 wherein the electrolysis is conducted at a pressure of at least about 30 psig.

7. The process of claim 1 wherein the divider is a cation selective membrane.

8. The process of claim 1 wherein the electrolyte is (B-1) a neutral electrolyte.

9. The process of claim 1 wherein the electrolyte is (B-2) an acidic electrolyte.

10. A process for preparing hydroxylammonium salts represented by the formulae $$(NH_3OH)^+{}_yX^{-y}$$

wherein X is an anion of an acid and y is a number equal to the valence of X, said process comprising electrolytically reducing a mixture comprising at least one nitrogen oxide and an organic or inorganic acid $H_yX$ provided the acid is not perchloric acid or sulfuric acid when the nitrogen oxide is nitric oxide, and wherein the mixture is electrolytically reduced in an electrolysis cell comprising an anolyte compartment containing an anode and an acid, a catholyte compartment containing a cathode and the mixture, said cathode comprising a packed bed of tungsten carbide particles or platinum on carbon, and a divider separating said anolyte and catholyte compartments.

11. The process of claim 10 wherein the nitrogen oxide comprises nitric oxide.

12. The process of claim 10 wherein the acid $H_yX$ is an inorganic acid selected from the group consisting of nitric acid, halogen acids, boric acid, and phosphorus-containing acids.

13. The process of claim 10 wherein the acid $H_yX$ is a carboxylic acid, organic phosphorus-containing acid or sulfonic acid.

14. The process of claim 10 wherein the acid $H_yX$ is nitric acid.

15. The process of claim 10 wherein the acid in the anolyte compartment is the same as the acid in the catholyte compartment.

16. The process of claim 10 wherein the acid $H_yX$ is selected from the group consisting of formic acid, acetic acid, methanesulfonic acid and toluenesulfonic acid.

17. The process of claim 10 wherein the cathode in the catholyte compartment comprises a gas diffusion cathode.

18. The process of claim 10 wherein the electrolysis is conducted at a pressure of at least about 30 psig.

19. The process of claim 10 wherein the electrolysis is conducted at a pressure of at least about 40 psig.

20. The process of claim 10 wherein the divider is a cation selective membrane.

21. A process for preparing hydroxylamine nitrate from nitric oxide in an electrolysis cell which comprises an anolyte compartment containing an anode, nitric acid and water, a catholyte compartment containing a cathode, and a cation-selective membrane separating said anolyte and catholyte compartments from each other, said process comprising the steps of:

(A) charging an aqueous mixture comprising nitric oxide and nitric acid to the catholyte compartment;

(B) maintaining the cell at a pressure of at least about 10 psig;

(C) passing a current through the electrolysis cell to produce hydroxylamine nitrate in the catholyte compartment; and (D) recovering the hydroxylamine nitrate from the catholyte compartment.

22. The process of claim 21 wherein the electrolysis is conducted by maintaining a pressure within the electrolysis cell of at least about 30 psig.

23. The process of claim 22 wherein the pressure is at least 40 psig.

24. The process of claim 22 wherein the cathode comprises a packed bed of tungsten carbide particles.

25. The process of claim 21 wherein the cation-selective membrane comprises a polyfluorosulfonic acid or a polyfluorosulfonic acid/polyfluorocarboxylic acid perfluorohydrocarbon polymer membrane.

26. The process of claim 21 wherein nitric oxide is bubbled through the acid in the catholyte compartment during electrolysis.

27. The process of claim 21 wherein the cathode in the catholyte compartment comprises a gas diffusion cathode, and nitric oxide gas is charged to the catholyte compartment during the electrolysis.

* * * * *